US010107547B1

(12) United States Patent
Kraminer

(10) Patent No.: US 10,107,547 B1
(45) Date of Patent: Oct. 23, 2018

(54) COMBINED THERMOELECTRIC COOLER AND BOTTLE WARMER AND METHODS THEREOF

(71) Applicant: Avi Kraminer

(72) Inventor: Avrohom Kraminer, Brooklyn, NY (US)

( * ) Notice: Subject to any disclaimer, the term of this patent is extended or adjusted under 35 U.S.C. 154(b) by 0 days.

(21) Appl. No.: 15/904,369

(22) Filed: Feb. 25, 2018

(51) Int. Cl.
*F25D 31/00* (2006.01)
*F25B 21/02* (2006.01)
*F25D 11/00* (2006.01)

(52) U.S. Cl.
CPC ..... *F25D 31/005* (2013.01); *F25B 21/02* (2013.01); *F25D 11/003* (2013.01); *F25D 2331/803* (2013.01); *F25D 2400/02* (2013.01); *F25D 2400/361* (2013.01)

(58) Field of Classification Search
CPC .... A47J 36/24; A47J 36/2411; A47J 36/2433; A47J 36/2438; A47J 31/54; F25D 31/005; F25D 31/007; F25D 2331/803; F25D 2400/36; F25D 2700/16; F24C 7/10
See application file for complete search history.

(56) References Cited

U.S. PATENT DOCUMENTS 3,432,641 A * 3/1969 Welke ..... A47J 36/2433 219/240
6,276,162 B1 * 8/2001 Schemel ..... A47J 47/14 220/592.01
6,619,070 B2 * 9/2003 Shin ..... A23B 7/0425 62/407
7,762,018 B1 7/2010 Fitzpatrick et al.
8,131,137 B1 * 3/2012 Cowles ..... A47J 36/2433 392/386
8,720,099 B1 5/2014 Sisk
2004/0140304 A1 * 7/2004 Leyendecker ..... A47J 36/2433 219/386
2006/0076379 A1 * 4/2006 Hussaini ..... B60R 7/043 224/275
2006/0218937 A1 * 10/2006 Park ..... A47D 13/00 62/3.3
2009/0145138 A1 * 6/2009 Ethier ..... F25D 31/007 62/3.6
2016/0210807 A1 * 7/2016 Rosenthal ..... G07F 9/105

* cited by examiner

*Primary Examiner* — Tho V Duong
(74) *Attorney, Agent, or Firm* — 1st-Tech-Ideas; Haim M. Factor

(57) ABSTRACT

A combined thermoelectric cooler and bottle warmer system for use at home and in vehicles, the system having a front and a back side, and having a lightweight and stable configuration, the system comprising: a bottle warmer/sterilizer/hot water unit located at the front of the system, the bottle warmer unit operated to heat a first bottle at temperatures ranging from ambient to 100 degrees C.; a control panel, located on the front of the system, the control panel serving to control the bottle warmer unit; a thermoelectric refrigerator unit; and a system enclosure enclosing the bottle warmer unit and the thermoelectric refrigerator unit; wherein the thermoelectric refrigerator unit and the bottle warmer unit are jointly and separately functional.

5 Claims, 7 Drawing Sheets

Detail A

COMBINED THERMOELECTRIC COOLER AND BOTTLE WARMER AND METHODS THEREOF

FIELD OF THE INVENTION AND BACKGROUND

The current invention relates to portable cooling and heating devices and specifically to a combined thermoelectric cooler and bottle warmer and methods thereof.

In the specification and claims which follow hereinbelow, the terms "mother", "father", and/or "parent", when used in conjunction with feeding a baby and or making preparations to do so, are intended to be used interchangeably to mean any caretaker for a baby—and not necessarily the baby's mother and/or father.

Mothers that breast feed typically store breast milk in the freezer or in the refrigerator for later use. When it comes time to feeding the baby, a mother typically warms up the chilled/frozen milk to about 40 degrees C. for it to be a comfortable temperature for the baby to drink. Feeding in middle of the night can be a hassle for a parent to go to the fridge, prepare the bottle, and then place the bottle in a bottle warmer. Some people keep a mini fridge in the nursery to store milk, making it easier to put the milk in the bottle and then into the bottle warmer without needing to go to the kitchen.

However, such a solution takes space and could nonetheless be inconvenient in the home. Traveling presents a bigger challenge to both provide prolonged cooling and convenient bottle warming. A number of prior art address the problem, as indicated hereinbelow.

"The First Years Night Cravings Bottle Warmer & Cooler" by Tomy®, Oak Brook, Ill. 60523, U.S.A., Y1058/Y6158 1309277, whose disclosure is incorporated by reference, provides a solution having an electric cord to power the bottle warmer from a house outlet. The device requires an ice pack that must be refilled/replaced relatively frequently. There are several manufacturers that make similar bottle warmers and coolers.

"Elite Baby" Bottle Cooler and Warmer, Model EB-BX02, by Foshan Shunde Jingai Living Electric Appliances Co. Ltd, China, whose disclosure is incorporated by reference, has a device which houses one bottle, allowing one "shift" control to switch cooling to warming, warming milk at 40 degrees C. and cooling milk to 9 degrees C.

In US Patent application publication no. 2008178605, whose disclosure is incorporated by reference, Wesley et al. describe a portable compact refrigerator especially designed for infant milk bottle, pacifies, baby food jars and the like. The refrigerator houses a bottle and food warmer that has an LCD indicator for both the bottle and jar warmer, a safety lock, a start button and a timer. The refrigerator has a main compartment and a door attached to the main compartment. The door houses a medicine cabinet with a roll up cover that sounds an alarm when opened. The roll up cover has a lock that can be either a key lock, cyber lock, or combination. The shelves on the door hold pacifiers, baby food jars and baby bottles. The door creates an air-tight seal when closed. Wheels attached to the bottom of the refrigerator allow for the portability of the compact refrigerator.

Zorn, in PCT publication no. WO2004106109, whose disclosure is incorporated by reference, describes a thermoelectric combination device, in particular an armrest cool box for motor cars. Said device comprises a thermoelectric container with a thermoelectric chamber for housing and insulating foodstuffs, substances and/or objects that are to be kept cold or hot and a sealable opening for accessing the thermoelectric chamber. The device also comprises a beverage-container holder, which is configured in the thermoelectric chamber to hold at least one container, in particular a beverage container, and an active thermoelectric device for the selective cooling and/or heating of the container or containers.

In U.S. Pat. No. 2,853,205, whose disclosure is incorporated by reference, Boyd describes a bottle and food warmer and cold storage device t make infant or invalid feeding and food storage convenient and compact and quick when a kitchen is inconvenient to get to or unavailable. The device has an insulated cold storage compartment, adapted to hold and cold store filled nursing bottles or other food and food containers for at least 12 hours within a safe temperature range and with a warming well adapted to head a nursing bottle or other food and food containers.

Pieronczyk et al. describe, in U.S. Pat. No. 7,305,833, whose disclosure is incorporated by reference, a cooling and warming apparatus which includes a housing having a top side with a number of open receptacles for receiving perishable items. Thermally-conductive bases are attached to the bottom of the receptacles. Thermoelectric elements are provided in thermal communication with the thermally-conductive bases. A heat sink having heat-dissipating fins is provided in thermal communication with at least one of the thermoelectric elements. A fan draws air into the housing, through the heat-dissipating fins of the heat sink, and out of the housing. A temperature controller controls the operation of one of the plurality of thermoelectric elements.

In Japan Patent publication no. JPH0791799, whose disclosure is incorporated by reference, Kenzo et al. describe an aluminum vessel provided as a container inside a lower case in a body, partitioned by a vessel partition unit to form vessel chambers, and a heat exchanger is disposed in a bottom of the vessel. The unit is formed with a plurality of communicating long holes and slidably mounted with a slide plate having communicating long holes at a slide groove. When the plate is moved, the chamber communicates with the chamber in response to the movement. The exchanger is disposed at the bottom of the vessel, and formed of a heat dissipating fin, a thermal conductor, and a Peltier element interposed to be held between the fin and the conductor.

Many, if not all of the prior art employ devices, having the same thermoelectric chip for both heating and cooling, have three major limitations:

1. using the same chip for heating and cooling shortens the device and thermoelectric chip life due to thermal cycling between hot and cold conditions;
2. the housing of many of the devices is not suitable nor sufficiently stable for vehicle transport and the devices and/or bottles could fall over easily;
3. in devices using the same thermoelectric chip, there is room only for one bottle, meaning, that the user must choose between either a cooling or a heating function, and using both functions at the same time is not possible.

There is therefore a need for a lightweight, portable, combined-but-separately functional, refrigerator/cooler and bottle warmer that may be used in the home and on the go (such as in vehicles), having a stable and reliable configuration.

SUMMARY OF INVENTION

According to the teachings of the current invention, there is provided a combined thermoelectric cooler and bottle warmer system for use at home and in vehicles, the system having a front and a back side, and having a lightweight and stable configuration, the system comprising: a bottle warmer/sterilizer/hot water unit located at the front of the system, the bottle warmer unit operated to heat a first bottle at temperatures ranging from ambient to 100 degrees C.; a control panel, located on the front of the system, the control panel serving to control the bottle warmer unit; a thermoelectric refrigerator unit; and a system enclosure enclosing the bottle warmer unit and the thermoelectric refrigerator unit; wherein the thermoelectric refrigerator unit and the bottle warmer unit are separately functional. Preferably, the bottle warmer unit further comprises: a unit cover; a unit well; and a heating cup having an outside surface, and wherein the heating cup is configured to be partially filled with water, the heating cup removably positioned within the unit well and wherein the first bottle removably positioned within the heating cup, and the unit cover removably positioned above the first bottle. Most preferably, the heating cup further includes a positive temperature coefficient (PTC) heating element therein, the heating element electrically-connected to the bottle warmer unit when the cup is positioned within the unit well, and the cup having thermal insulation on part of the outside surface. Typically, the control of the bottle warmer unit includes: activation/deactivation of the bottle warmer; target heating mode determination for heating the first bottle; control of a heating target temperature of the first bottle; display of a current temperature of the first bottle; temperature display being in C and F; and control of a time the first bottle is maintained at a given temperature. Most typically, the refrigeration unit includes at least one refrigeration space and a cover thereupon, the cover having an open and a closed position, with the cover having a refrigerator seal therein to provide a refrigeration/condensation seal on the at least one refrigeration space when the refrigerator cover is in a closed position.

Preferably, the refrigeration unit includes a thermoelectric cooling device, the refrigeration unit having light weight and simplicity of operation. Most preferably, the system has an AC power and a DC power input socket and a power on-off switch, the unit powered by either 110/220 V AC or 12 V DC. Typically, a second bottle holder is configured uncovered and next to the bottle warmer unit. Most typically, a carrying handle is rotatably affixed on hinges, the hinges connected to the system enclosure, the carrying handle having an open position for carrying the system and a stowed/closed position. Preferably, the system has additional straps having connectors configured to securely connect the system to universal vehicle systems, the system secured with the front of the system facing forward within the vehicle.

According to the teachings of the current invention, there is further provided a method of using a combined thermoelectric cooler and bottle warmer system for use at home and in vehicles, the system having a front and a back side and having a lightweight and stable configuration, the method comprising: locating a bottle warmer/sterilizer/hot water unit at the front of the system and operating the bottle warmer unit to heat a first bottle at temperatures ranging from ambient to 100 degrees C.; operating a control panel, located on the front of the system, to control the bottle warmer unit; and configuring a system enclosure to enclose the bottle warmer unit and a thermoelectric refrigerator unit, whereby the thermoelectric refrigerator unit and the bottle warmer unit function separately. Preferably, the bottle warmer unit further includes: a unit cover; a unit well; and a heating cup, and whereby heating the first bottle is performed by partially filling the cup with water, placing the bottle within the heating cup, placing the cup, having water and the first bottle, into the unit well, and positioning the unit cover above the first bottle. Most preferably, operating the control panel includes: activation/deactivation of the bottle warmer; determining a target heating mode for heating the first bottle; controlling a heating target temperature of the first bottle; displaying a current temperature of the first bottle; and controlling a time the first bottle is maintained at a given temperature. Typically, the refrigeration unit includes at least one refrigeration space and a cover thereupon, the cover having an open and a closed position, with the cover having a refrigerator seal therein, providing a refrigeration/condensation seal on the at least one refrigeration space when the refrigerator cover is in a closed position. Most typically, a carrying handle is rotatably affixed on hinges, the hinges connected to the system enclosure, the carrying handle having an open position for carrying the system and a stowed/closed position. Preferably, the system is securely connected to the vehicle using additional straps connected to universal vehicle systems, the system secured with the front of the system facing forward in the vehicle.

LIST OF FIGURES

The invention is herein described, by way of example only, with reference to the accompanying drawings, wherein.

DETAILED DESCRIPTION

Embodiments of the present invention provide for a lightweight, portable, combined-but-separately functional, refrigerator/cooler and bottle warmer that may be used in the home and on the go (such as in vehicles), having a stable and reliable configuration, and having a bottle warmer that additionally allows for sterilization of a baby bottle.

To address the issues mentioned hereinabove, embodiments of the current invention, as described further hereinbelow provide for a device that is sufficiently large to accommodate a mother's needs for an exemplary midnight feeding. Additionally, embodiments of the current invention serve to facilitate mobility, with the device having a built-in handle and AC/DC power options for home or travel use.

Figure 1:
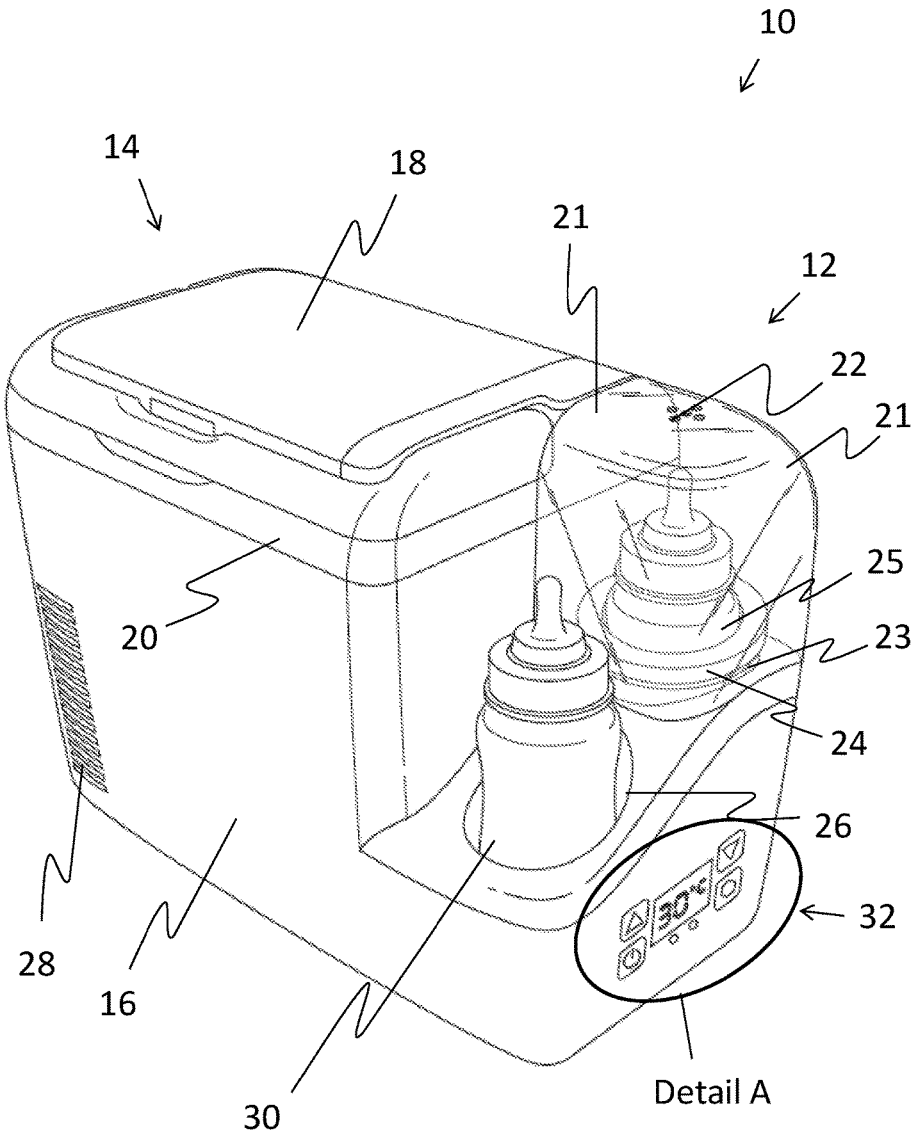
FIGS. 1 and 2 are isometric views of a combined thermoelectric cooler and bottle warmer system, in accordance with embodiments of the current invention.
Figure 2:
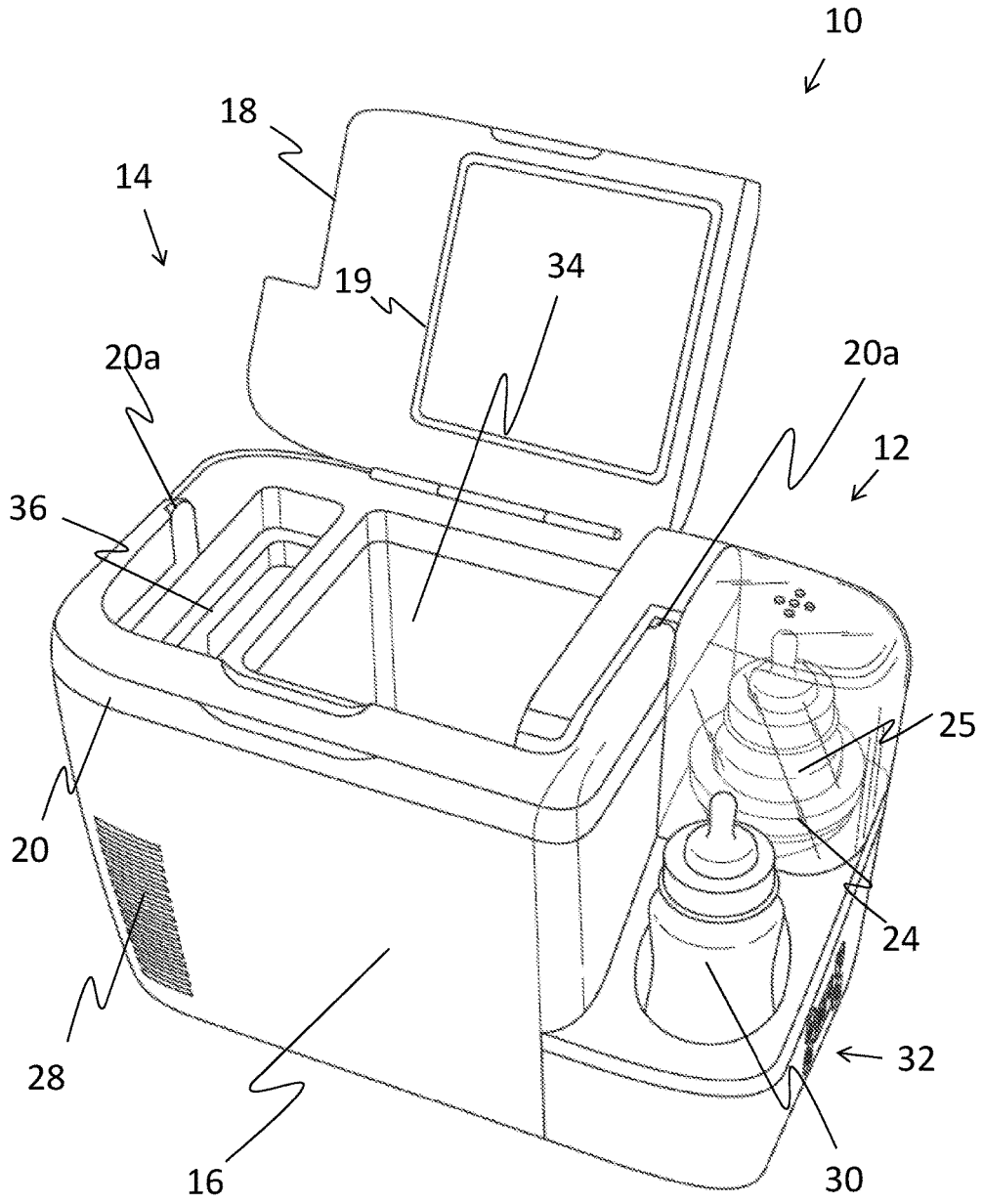

Reference is currently made to FIGS. 1 and 2, which are isometric views of a combined thermoelectric cooler and bottle warmer system 10, in accordance with embodiments of the current invention. The thermoelectric cooler and bottle warmer system includes: a bottle warmer/sterilizer/hot water unit 12; a thermoelectric refrigerator unit 14; and a system enclosure 16 enclosing bottle warmer/sterilizer/hot water unit 12 and thermoelectric refrigerator unit 14. The thermoelectric refrigerator unit includes a refrigerator cover 18. An integrated system carrying handle 20 is shown in the current figure in a stowed/stored configuration. The bottle warmer/sterilizer/hot water unit (referred hereinbelow as "bottle warmer unit") includes: a bottle warmer unit cover 21, having ventilation holes 22 as shown in the figure, a unit well 23; a unit heating cup 24, and an exemplary bottle 25. The thermoelectric refrigerator unit additionally includes ventilation openings 28, which are discussed further hereinbelow.

An additional cup/bottle holding well 26 with an exemplary additional bottle 30 are located next to the bottle warmer unit, as shown in the figures. Optionally or alternatively, cup/bottle holding well 26 may hold a cup or any other bottle or vessel, such as but not limited: a water bottle, a can of juice, and a coffee cup.

In the specification and claims which follow, in the context of embodiment of the current invention, the word "bottle" is intended to mean any cup, bottle, or vessel, such as but not limited: a baby bottle (as shown in the figures), a water bottle, and any vessel that has a general cylindrical shape and which may be used for safely heating a liquid therein.

Combined thermoelectric cooler and bottle warmer system 10 is oriented so that a front face of the system is the part of the system facing forward when the system is located and secured, typically between front seats or on the rear seat of a car. The front of the system is directed generally to the direction of travel. A control panel 32, identified as "Detail A" in FIG. 1, is located on the front of the system. A discussion of the control panel and exemplary configurations thereof follows hereinbelow.

Refrigerator cover 18 is shown in FIG. 2 in an opened position, with refrigerator seal 19 visible on the inner surface of the refrigerator cover. Additionally visible in FIG. 2 are two hinges 20*a*, which provide a mechanical rotatable connection of carrying handle 20 system enclosure 16, enabling the carrying handle to rotate about the hinges upwards from the combined thermoelectric cooler and bottle warmer system. As noted hereinabove, the carrying handle is shown in the figures in a stowed/stored configuration. The carrying handle may be easily grasped and rotated substantially 90 to a deployed/opened configuration—convenient for carrying combined thermoelectric cooler and bottle warmer system 10.

A refrigeration space 34 is part of refrigeration unit 14 and the refrigeration space is maintained at typical refrigeration temperatures, as known in the art. Refrigerator seal 19 is configured to provide a refrigeration/condensation seal on refrigeration space 34 when refrigerator cover 18 is in a closed position, as shown in FIG. 1. An auxiliary storage space 36 is identified as part of refrigeration unit 14. The auxiliary storage space is located next to refrigeration space 34 and, as can be seen in the figure, the storage space being unrefrigerated and having no seal when refrigerator cover 18 is in a closed position. Alternatively or optionally, storage space 36 may additionally be refrigerated, for refrigerated storage of smaller items, such as, but not limited to medicines and small containers. In such a case, the shape of refrigerator seal 19 is modified/adapted, mutatis mutandis, to include sealing of storage space 36.

Supporting refrigeration components (not shown in the figure) for refrigeration unit 14 are located beneath unrefrigerated storage space 36 and ventilation openings 28 serve to enable air circulation for refrigeration component cooling, as known in the art.

Figure 3A:
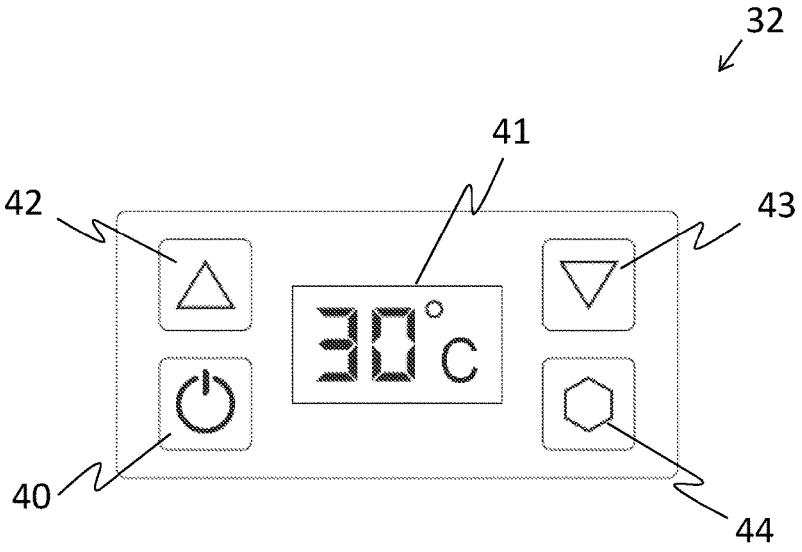
FIGS. 3A and 3B are graphic representations of the control panel shown in FIGS. 1 and 2 and of an exemplary control panel, in accordance with embodiment of the current invention.
Figure 3B:
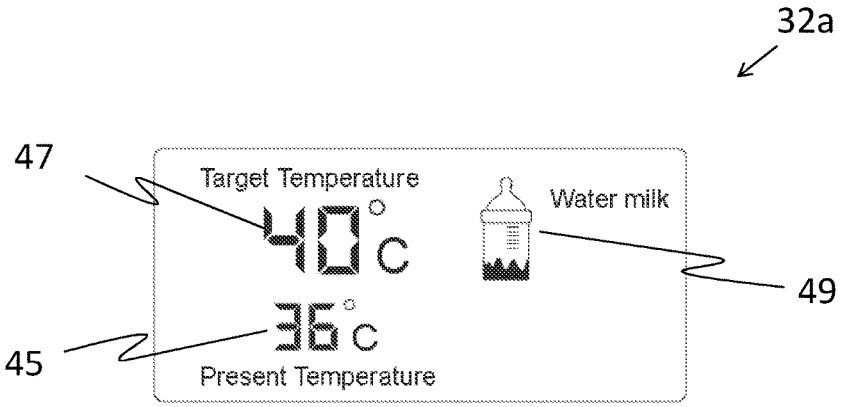

Reference is currently made to FIGS. 3A and 3B, which are graphic representations of control panel 32, shown in FIGS. 1 and 2, and of an exemplary control panel 32*a*, in accordance with embodiment of the current invention. Control panel 32 and exemplary control panel 32*a* serve to control bottle warmer unit 12 (ref FIGS. 1 and 2) as described further hereinbelow. Both control panels employ LCD elements and/or pressure-sensitive buttons—as known in the art. Control panel 32 includes: an on-off control button 40; a bottle warmer temperature display 41; an increase-value button 42; a decrease-value button 43; and a setup button 44. The bottle warmer unit is operated at temperatures ranging from ambient to 100 degrees C., as described further hereinbelow.

Once the bottle warmer is activated by pushing the on-off control button, setup button 44 is used to control various displays and functions of bottle warmer unit 12. An example of one display/function is exemplary control panel 32*a*, which includes: present temperature display 45; target temperature display 47; and bottle warmer unit mode display 49. With reference to control panel 32 (FIG. 3A), embodiments of the current invention include display and functionality, controlled by setup button 44, including, but not limited to:

- preset target heating modes of 30, 40, 50, 60, and 100 degrees C., with an associated name for each mode (ref "Warm milk" correspondign to 40 degrees C. in FIG. 3B);
- display and monitoring of current temperature of the bottle (bottle warmer temperature display 41, FIG. 3A, and present temperature display 45, FIG. 3B);
- display of temperature values in C or F (not shown in the figures);
- timer control (not shown in the figures) to control, for example, the time a bottle is maintained at 100 degrees C. for sterilization or the time a bottle is to be maintained at 40 degrees C.; and
- controlling heating target temperatures 'manually' by using increase-value and decrease-value buttons 42 and 43, respectively.

An exemplary sequence of operation of the bottle warmer unit, using the control panel follows hereinbelow.

1. Press on-off control button 40 once to activate the bottle warmer unit.
2. Press setup button 44; the display will blink, with one or more options and/or temperature values.
3. To choose a temperature value, press the increase-value and/or decrease-value buttons to choose between one of the preset temperatures (example: 40 C warm milk, 60 C warm food, 100 C sterilize).
4. Press setup button 44 to select the chosen temperature.

To deactivate/turn off the bottle warmer unit, press setup button 44 for 3 seconds.

Exemplary timer control (as noted hereinabove) is performed by pressing the setup button (as in step 2 above) and then choosing timer control values (in minutes) and proceeding as per step 3, mutatis mutandis. Alternatively or optionally, timer values are automatically associated with the present temperatures.

Figure 4:
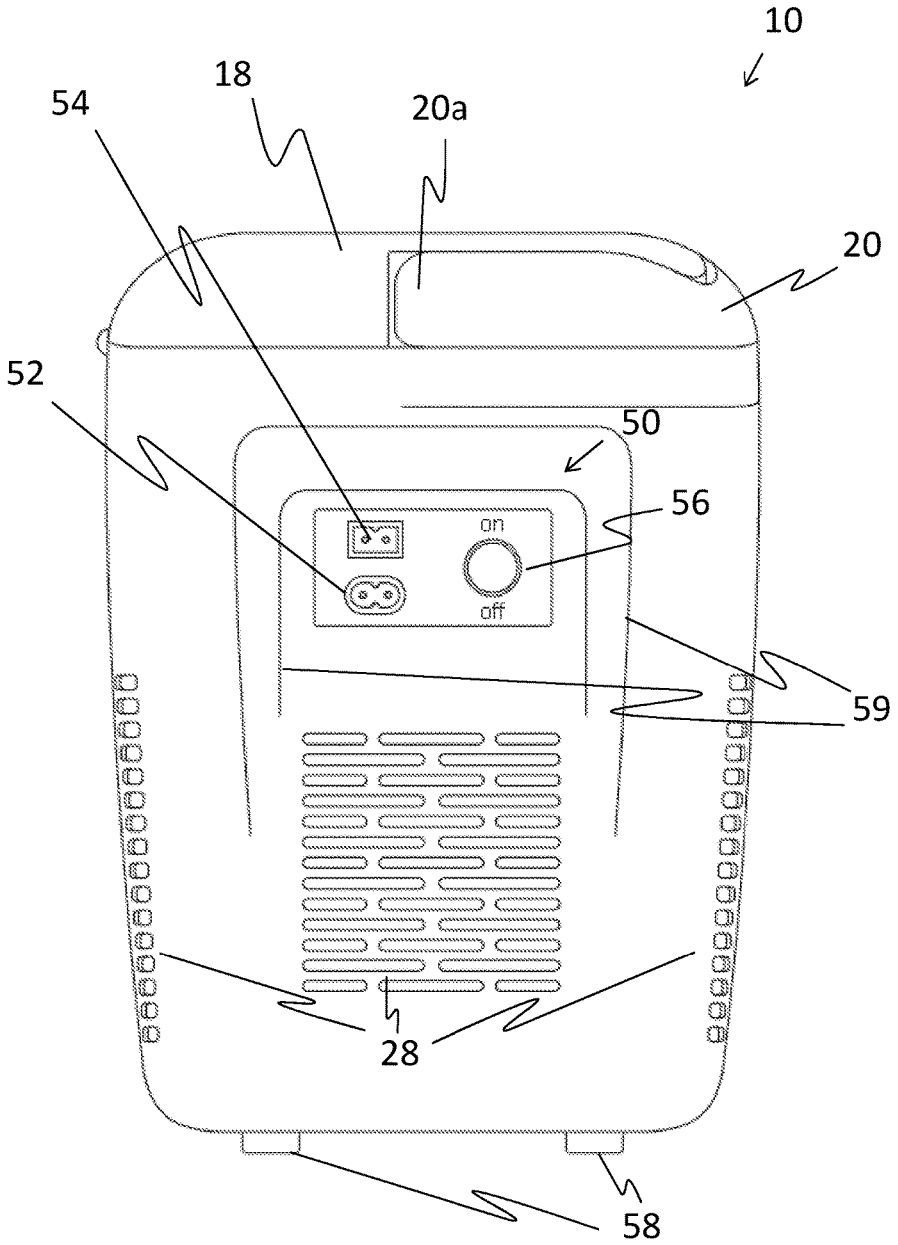
FIG. 4 is a drawing of a rear face of the combined thermoelectric cooler and bottle warmer system shown in FIGS. 1 and 2 hereinabove, in accordance with embodiments of the current invention.

Reference is currently made to FIG. 4, which is a drawing of a rear face of the combined thermoelectric cooler and bottle warmer system shown in FIGS. 1 and 2 hereinabove, in accordance with embodiments of the current invention. The rear face of system 10 is opposed to the front face of the system, as described hereinabove (ref FIGS. 1 and 2). Apart from differences described below, system 10 of FIGS. 1 and 2 (hereinabove) is identical in notation, configuration, and functionality to that shown in FIG. 4 and elements indicated by the same reference numerals and/or letters are generally identical in configuration, operation, and functionality as described hereinabove. A system power control panel 50 is shown in FIG. 4, the power control panel including: an AC power input socket 52; a DC power input socket 54; and a power on-off switch 56. Two cords (not shown in the figures) allow connection of the system to appropriate power sources: either 110/220 V AC or 12 V DC. After the unit is connected to power, the power on-off switch is switched to the "on" position, thereby enabling refrigeration unit 14 functioning and providing power to the bottle warmer unit (which is further controlled by the control panel). The refrigeration unit functions using a Peltier or similar thermoelectric cooling device, affording system light weight and simplicity of operation.

Embodiments of the current invention include the refrigeration unit operating at a 36 W power level (ie 12 V and 3A) and the bottle warmer unit operating at 60 w (12V, 5 a). To minimize total power usage, when the bottle warmer unit is active, the working, the refrigeration unit is automatically switched to "eco mode", drawing only 15 w (5 v 3 a). The refrigeration unit is automatically switched back to nominal 36 W operating mode when the bottle warmer unit is inactive.

Legs 58 are shown at the base of the system. Optionally or alternatively, additional straps with connectors (not shown in the figures) serve to securely connect system 10 to universal car/vehicle systems, such as, but not limited to: LATCH and Isoflex®.

System control panel 50 and the ventilation openings viewed beneath the control panel are set into a depression 59 in the rear face of system 10 to allow the system to be positioned against a wall and/or seat and to nonetheless allow space for sufficient ventilation and/or connecting cords (not shown in the figures) to the input power sockets.

Figure 5:
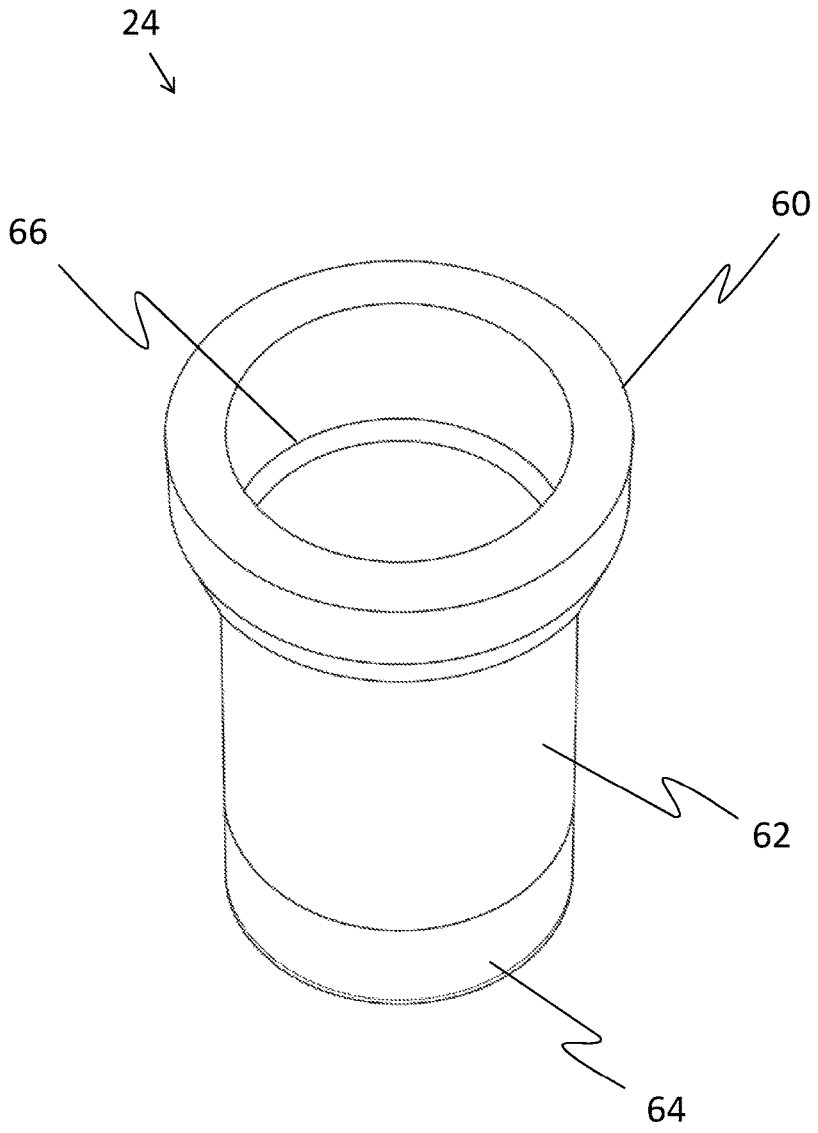
FIGS. 5 and 6 are isometric views of the heating cup shown previously in FIGS. 1 and 2, in accordance with an embodiment of the current invention.
Figure 6:
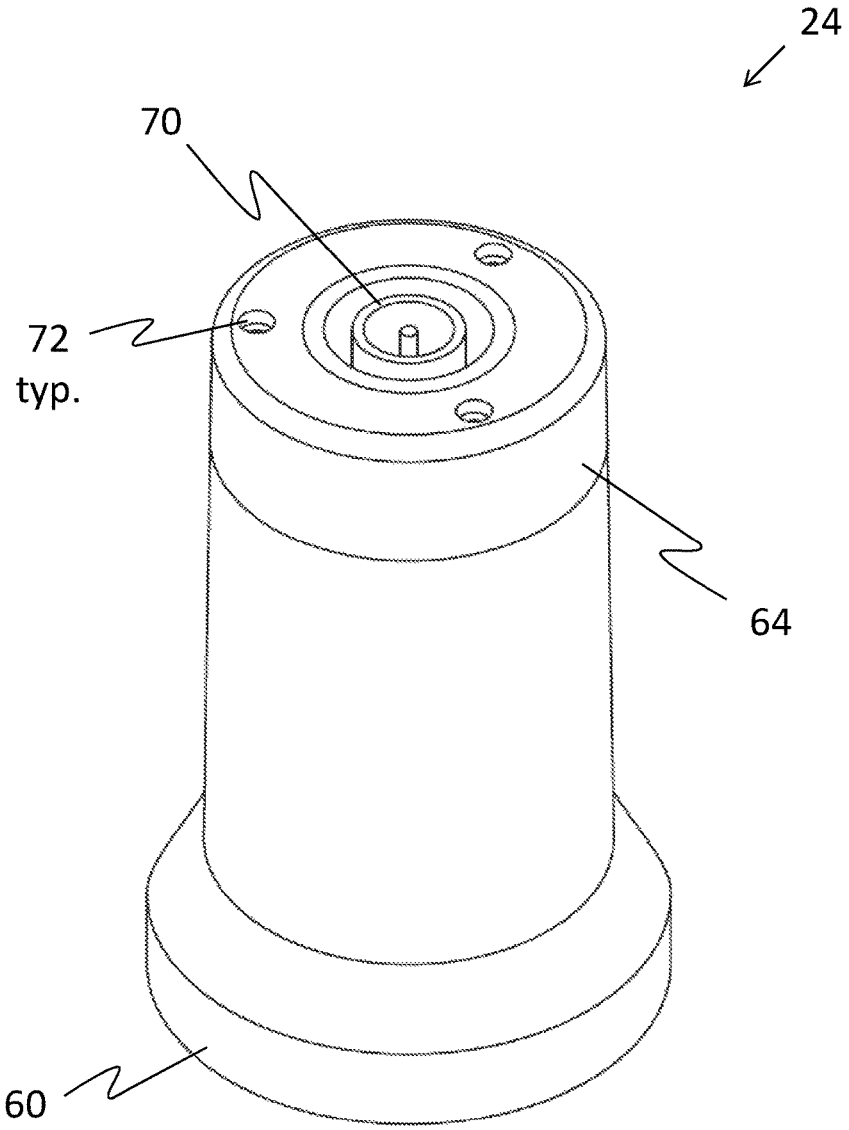

Reference is currently made to FIGS. 5 and 6, which are isometric views of heating cup 24 shown previously in FIGS. 1 and 2, in accordance with an embodiment of the current invention. Apart from differences described below, cup 24 in FIGS. 1 and 2 is identical in notation, configuration, and functionality to that shown in FIGS. 5 and 6 and elements indicated by the same reference numerals and/or letters are generally identical in configuration, operation, and functionality as described hereinabove. Cup 24 is made of a stable and thermally-conductive material, such as, but not limited to: stainless steel and aluminum. The cup has a generally cylindrical shape and the cup is formed with an upper lip 60 and an elongated body 62. Thermal insulation, to allow safe handling, is present on the outside of an upper surface of lip 60 and along a base strip 64 of the cup. The insulation includes insulative materials, such as, but not limited to: an air space, thermoplastic, and silicone materials.

As shown in FIG. 1, cup 24 is formed to be removably seated within heating well 23 and the cup is shaped to receive an exemplary bottle (or another similar-shaped container) therein. FIG. 6 shows cup 24 in an inverted position, including female connector 70 and three exemplary base connectors 72. Female connector 70 is similar to that found in the base of a standard electric kettle.

A heating element (not shown in the figures) is configured at the base of the cup and is electrically connected to female connector 70 and thermally connected to the cup, in a configuration similar to that for a standard electric kettle, as known in the art. The heating element is a positive temperature coefficient (PTC) element. Base connectors 72 serve to secure female connector 70 and the heating element to cup 24.

Figure 6A:
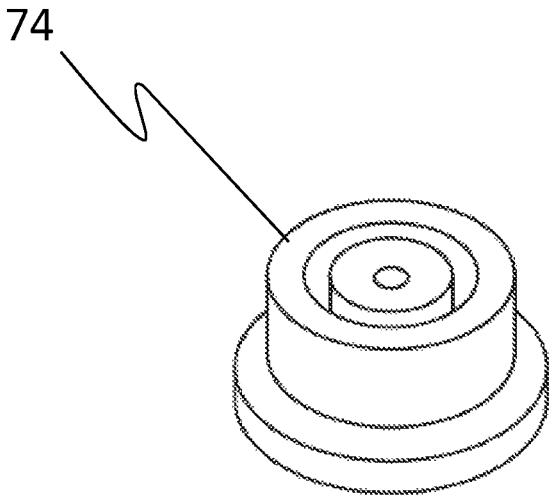
FIG. 6A is an isometric view of a male connector, in accordance with embodiments of the current invention.

Reference is currently made to FIG. 6A, which is an isometric view of a male connector 74, in accordance with embodiments of the current invention. Male connector is mounted within heating well 23 and is configured to accept and electrically mate with female connector 70 of cup 24, when the cup is placed into the well—having a configuration similar to that of standard electric kettles.

To enhance and enable proper/uniform heating of the bottle, as known in the art, a quantity of water (not shown in the figures) is initially placed in cup 24, with the water acting as a heating medium between the cup and the bottle.

It will be appreciated that the above descriptions are intended only to serve as examples, and that many other embodiments are possible within the scope of the present invention as defined in the appended claims.

The invention claimed is:

1. A combined thermoelectric cooler and bottle warmer system for use at home and in vehicles, the system having a front and a back side, the system comprising:

a bottle warmer/sterilizer/hot water unit located at the front of the system, the bottle warmer unit operated to heat a first bottle at temperatures ranging from ambient to 100 degrees C.;

a control panel, located on the front of the system, the control panel serving to control the bottle warmer unit;

a thermoelectric refrigerator unit; and a system enclosure enclosing the bottle warmer unit and the thermoelectric refrigerator unit;

wherein the thermoelectric refrigerator unit and the bottle warmer unit are combined but separately functional;

wherein the bottle warmer unit further comprises: a unit cover; a unit well; and a heating cup having an outside surface, and wherein the heating cup is configured to be partially filled with water, the heating cup removably positioned within the unit well and wherein the first bottle is removably positioned within the heating cup, and the unit cover removably positioned above the first bottle; and wherein the heating cup further includes a positive temperature coefficient (PTC) heating element therein, the heating element electrically-connected to the bottle warmer unit when the cup is positioned within the unit well, and the cup having thermal insulation on part of the outside surface.

2. The system of claim 1, wherein the control of the bottle warmer unit includes: activation/deactivation of the bottle warmer; target heating mode determination for heating the first bottle; control of a heating target temperature of the first bottle; display of a current temperature of the first bottle; temperature display being in C and F; and control of a time the first bottle is maintained at a given temperature.

3. The system of claim 2, wherein the refrigeration unit includes at least one refrigeration space and a cover thereupon, the cover having an open and a closed position, with the cover having a refrigerator seal therein to provide a refrigeration/condensation seal on the at least one refrigeration space when the refrigerator cover is in a closed position.

4. A method of using a combined thermoelectric cooler and bottle warmer system for use at home and in vehicles, the system having a front and a back side, the method comprising:

locating a bottle warmer/sterilizer/hot water unit at the front of the system and operating the bottle warmer unit to heat a first bottle at temperatures ranging from ambient to 100 degrees C.;

operating a control panel, located on the front of the system, to control the bottle warmer unit; and configuring a system enclosure to enclose the bottle warmer unit and a thermoelectric refrigerator unit, whereby the thermoelectric refrigerator unit and the bottle warmer unit are combined and separately functional;

whereby the bottle warmer unit further comprises: a unit cover; a unit well; and a heating cup having an outside surface, and whereby heating the first bottle is performed by partially filling the cup with water, placing the bottle within the heating cup, placing the cup, having water and the first bottle, into the unit well, and positioning the unit cover above the first bottle; and whereby the heating cup further includes a positive temperature coefficient (PTC) heating element therein, the heating element electrically-connected to the bottle warmer unit when the cup is positioned within the unit well, and the cup having thermal insulation on part of the outside surface.

5. The method of claim 4, whereby operating the control panel includes: activation/deactivation of the bottle warmer; determining a target heating mode for heating the first bottle; controlling a heating target temperature of the first bottle; displaying a current temperature of the first bottle; and controlling a time the first bottle is maintained at a given temperature.

* * * * *